United States Patent [19]

Stephens

[11] Patent Number: 4,599,682

[45] Date of Patent: Jul. 8, 1986

[54] POSITION RESPONSIVE LIGHTING APPAREL

[75] Inventor: Eugene Stephens, Southfield, Mich.

[73] Assignee: DeVerohn Corporation, Southfield, Mich.

[21] Appl. No.: 667,808

[22] Filed: Nov. 2, 1984

[51] Int. Cl.[4] ..... F21L 15/08

[52] U.S. Cl. ..... 362/103; 362/184; 362/190; 362/191; 362/208; 362/225; 362/252; 362/296; 362/347; 362/448; 362/455; 362/800

[58] Field of Search ..... 362/103, 104, 108, 184, 362/190, 191, 249, 251, 295, 800

[56] References Cited

U.S. PATENT DOCUMENTS

| | | | |
|---|---|---|---|
| 3,840,853 | 10/1974 | Cukale | 362/108 X |
| 4,112,482 | 9/1978 | Powell | 362/108 |
| 4,296,459 | 10/1981 | DeLuca | 362/104 |

*Primary Examiner*—Stephen J. Lechert, Jr.
*Attorney, Agent, or Firm*—Charles W. Chandler

[57] ABSTRACT

An item of apparel is disclosed that can be worn on various parts of the body such as the ankle, the arm, the wrist or the like comprising a fabric sleeve having Velcro at its ends so that it can be formed into a loop embracing the user's limb. A series of light-emitting diodes are mounted on the sleeve and connected to a battery powered circuit having a mercury switch so that the diodes are illuminated depending upon the position of the user's limb. Each diode is mounted in a reflector that magnifies the diode's illumination.

3 Claims, 7 Drawing Figures

POSITION RESPONSIVE LIGHTING APPAREL

BACKGROUND OF THE INVENTION

This invention is related to wearing apparel for attracting attention to the user by intermittently illuminated lighting means, and more particularly to such apparel in which a series of light-emitting diodes are individually mounted on a reflector which magnifies the illumination of the diode, and connected to a mercury switch so that the diode's illumination depends upon the position of the user's limb.

There are a variety of activities in which a user desires to attract attention either to warn others of his presence or for other reasons such as when the user is roller skating, ice skating, bike riding at night, directing a safety patrol, jogging or walking at night, or dancing.

SUMMARY OF THE INVENTION

The broad purpose of the present invention is to provide a farbic article that can be worn on a selected portion of the user's body such as an ankle, an arm or a wrist to illuminate a series of light emitting diodes depending upon the position of the limb on which the device is being worn.

In the preferred embodiment of the invention, the illumination is provided by a series of lighting emitting diodes connected to a battery employing a mercury switch so that the diodes are illuminated depending upon the position of the user's limb. Each diode is mounted in the fabric employing a novel mounting which includes a reflective, partially spherical member having a central opening and mounted on the outside of the fabric so that the illumination of the diode is magnified by the reflector. The mounting also permits the diode to be easily snapped into position or removed if the article needs cleaning or replacement.

The device provides a highly visible means, particularly in the dark for attracting attention to the user. It can be used by dancers, joggers, walkers, bicycle riders and the like to attract attention to their presence.

Still further objects and advantages of the invention will become apparent to those skilled in the art to which the invention pertains upon reference to the following detailed description.

DESCRIPTION OF THE DRAWING

The description refers to accompanying drawings in which like reference characters refer to like parts throughout the several views, and in which.

DESCRIPTION OF THE PREFERRED EMBODIMENT

Figure 1:
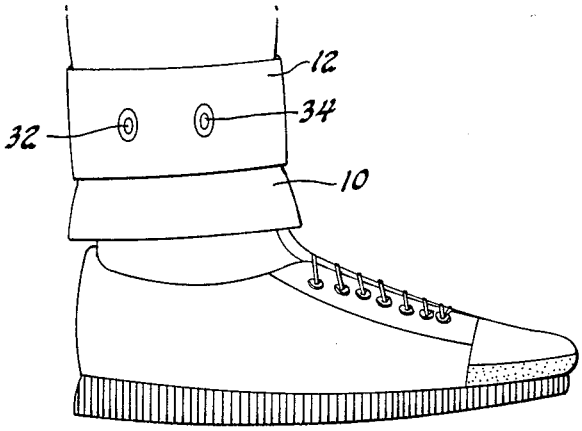
FIG. 1 is the view of the preferred embodiment of the invention being worn on the ankle of the user.
Figure 2:
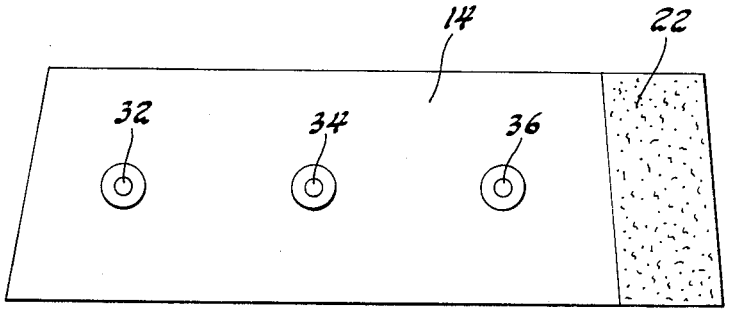
FIG. 2 is a view of one side of the preferred embodiment.
Figure 3:
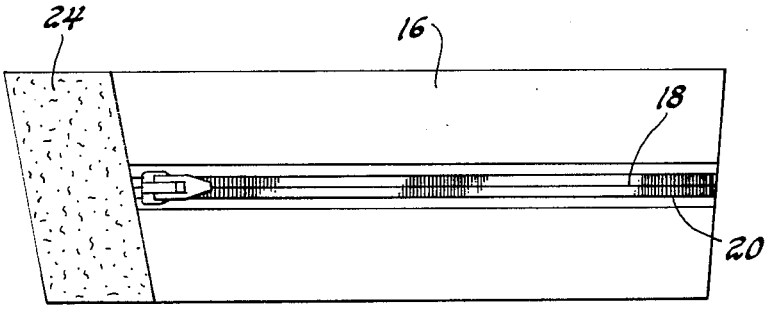
FIG. 3 is a view of the opposite side thereof.

Referring to the drawings, FIG. 1 illustrates a user's ankle 10. A preferred lighting apparel 12 is mounted on the ankle. Lighting apparel 12 preferrably comprises a pair of elongated fabric strips 14 and 16 sewn about their edges to form a sleeve with longitudinal opening 18. Zipper means 20 is attached along opening 18.

A conventional Velcro fabric 22 is attached to one end of the sleeve, comprising a plurality of fabric hooks. A complementary section of Velcro fabric 24 is attached to the opposite side of the sleeve comprising a plurality of fabric loops that are engageable with Velcro strip 22 so that the sleeve can be mounted around the user's ankle, his arm or his wrist.

Figure 4:
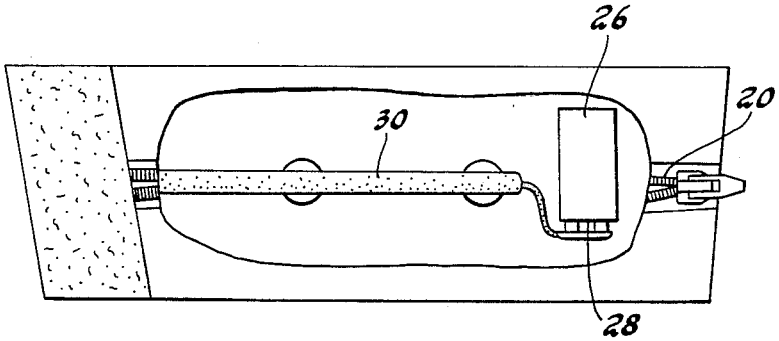
FIG. 4 is a fragmentary view of preferred embodiment sleeve to expose its interior.

FIG. 4 illustrates the sleeve interior which includes a pocket 26 containing a direct current battery 28. Conductor means 30 are connected to the battery for illuminating three light-emitting diodes (LED) 32, 34, and 36. A conventional mercury switch 38 is connected in the conductor means so that the illumination of the LED's depends upon the attitude of the sleeve, that is, in certain positions it will illuminate and in other positions it will be unlighted depending upon whether the switch 38 is in a conducting or non-conducting position.

Figure 5:
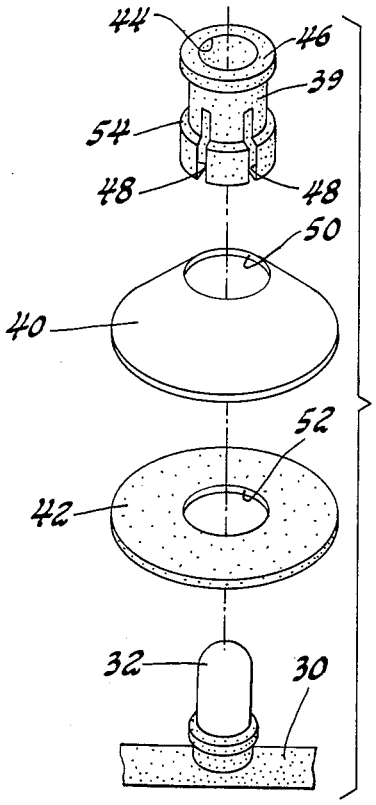
FIG. 5 is an exploded view of the LED mounting assembly.
Figure 6:
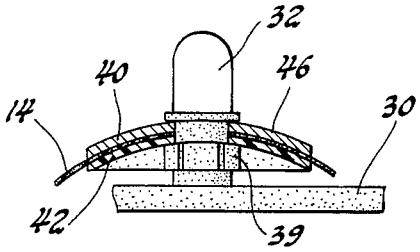
FIG. 6 is a sectional view showing the manner in which each LED is mounted on the fabric.
Figure 7:
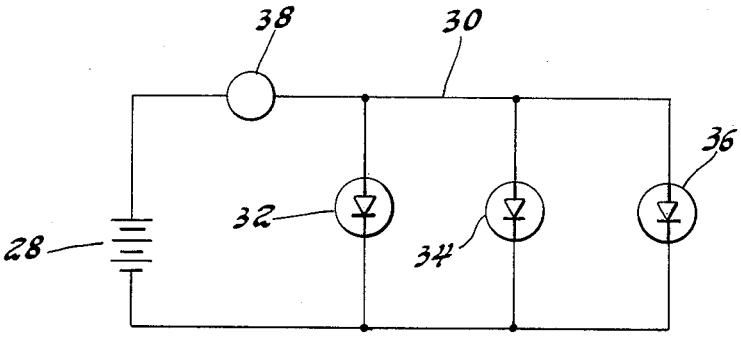
FIG. 7 is a view of a preferred electrical circuit.

The three LED's are connected in parallel in the circuit and each is mounted in a similar manner to the fabric of the sleeve. For example, LED 32, as shown in FIGS. 5 and 6, which is a conventional high-intensity, light-emitting diode, is mounted in an assembly comprising a transparent, tubular sleeve 39, reflector 40 and locking washer 42. The LED is relatively elongated with a glass housing. Sleeve 39 has an internal diameter 44 adapted to receive the LED so that its outer end extends beyond fabric strip 14, as illustrated in FIG. 6. Sleeve 39 includes a collar 46 having a diameter greater than the opening in the fabric. The tube also has a plurality of longitudinal slots 48 extending from its lower end to form a plurality of resilient, compressible legs.

Reflector 40 has a generally semi-spherical configuration, and a central opening 50 adapted to receive the sleeve 39 but having a diameter less than collar 46. The outer surface of the reflector has a reflective surface to magnify the light of the LED. Locking washer 42 has a central opening 52 adapted to engage the compressible legs of the sleeve to frictionally engage the LED. Sleeve 39 also has a bulge 54 over which the locking washer passes so as to be releasably retained in position.

The arrangement is such that when the locking washer is mounted on the legs of sleeve 39, the washer clamps the fabric between the washer and the reflector. The LED can be released from or snapped into its position in the tubular member without separating the washer from the tubular member. For this reason the internal diameter of the tubular member has a groove (not shown) for releasably retaining the LED in position.

The fabric of the case can come in a variety of materials or colors. The LEDs can also be provided in different, commercially-available colors.

One advantage of each reflector is that it magnifies the low power illumination of an LED so that it is visible as far as 1000 feet at night.

The mercury switch provides a blinking illuminator when the user is in motion. Further, the preferred apparel can be used on a traffic control person by mounting such apparel with red LED's on one arm and another apparel with green LED's on his other arm for directing traffic by moving his arms.

Having described my invention, I claim:

1. Position-responsive lighting apparel, comprising:

a fabric-wearing member having cooperating fastener means for mounting the wearing member on the user;

a source of direct current power mounted in the wearing member;

a light-emitting diode;

circuit means connecting the source of direct current and the light-emitting diode including position-responsive means connected such that the light emitting diode is illuminated depending upon the attitude of the wearing member;

means for mounting the light-emitting diode on the wearing member comprising;

a partially spherical, reflective member having a central opening and a convex reflecting surface, the reflective member being mounted on the wearing member; and means in the central opening for engaging and supporting the light-emitting diode in a position with respect to the convex reflective surface that the reflective surface spreads the illumination emitted by the diode.

2. Position-responsive lighting apparel, comprising:

a fabric-wearing member having fastener means for cooperating to mount said wearing member on the user;

a direct current battery mounted in the wearing member;

a light-emitting diode;

elongated, flexible, electrical conductor means electrically connecting the battery and the light-emitting diode, and including a mercury switch connected to the light-emitting diode so as to be operative for either electrically connecting or disconnecting the diode from the battery depending upon the attitude of the wearing member;

means for mounting the light-emitting diode on the wearing member, comprising:

a reflective member having a central opening and a convex light-reflective surface;

means receivable in the central opening for engaging and supporting the light-emitting diode adjacent the convex reflective surface, said means including a hollow, tubular element having an inner diameter suited for receiving the light-emitting diode therein, and resilient legs;

collar means on one end of the tubular member having an outer diameter greater than the central opening of the reflective member and engageable with the reflective member on one side of the wearing member; and a washer having a central opening for receiving the legs to clamp the light-emitting diode between the legs, the washer being mounted on the opposite side of the fabric wearing member as the collar to clamp the reflective member and the wearing member therebetween.

3. Means for mounting a diode on a fabric wearing member having a diode-mounting opening comprising:

a partially spherical, reflective member having a central opening and a convex reflecting surface, the reflective member being mounted on one side of the wearing member with the central opening adjacent the diode mounting opening;

means in the central opening for engaging and supporting the light-emitting diode in a position adjacent the convex reflective surface in such a manner that the reflective surface spreads the illumination emitted by the diode, said means including:

a hollow tubular member having an inner diameter suited for receiving the light-emitting diode therein, the tubular member being receivable in the central opening of the reflective member, the tubular member having resilient legs;

collar means on one end of the tubular member having an outer diameter greater than the central opening of the reflective member; and a washer having a central opening for receiving the tubular member so as to compress said legs to engage the light-emitting diode to fasten same to the reflective member;

whereby the tubular member and the diode are mounted in the diode-mounting opening in the wearing member, and the wearing member and the reflective member are clamped between the collar means and the washer.

* * * * *